United States Patent [19]

Thompson

[11] 4,189,126

[45] Feb. 19, 1980

[54] RIM SHIELD

[76] Inventor: Joe G. Thompson, 20635 6th Ave. SW., Seattle, Wash. 98166

[21] Appl. No.: 956,338

[22] Filed: Oct. 31, 1978

Related U.S. Application Data

[63] Continuation of Ser. No. 845,980, Oct. 27, 1977, abandoned.

[51] Int. Cl.[2] ..... E04G 17/00

[52] U.S. Cl. ..... 249/205; 222/51; 249/108; 285/5; 425/169; 425/171

[58] Field of Search ..... 249/205, 108; 425/169, 425/171, 447; 33/378; 222/51; 285/5

[56] References Cited

U.S. PATENT DOCUMENTS

| | | | |
|---|---|---|---|
| 48,296 | 6/1865 | McGirr | 222/51 |
| 191,971 | 6/1877 | Johnston | 222/51 |
| 1,743,431 | 1/1930 | Congable | 285/5 |
| 3,288,424 | 7/1966 | Dean | 249/108 |

*Primary Examiner*—William E. Schulz

[57] ABSTRACT

A rim shield is disclosed for use in conjunction with a porous mold in molding ceramic articles using a slip casting process. Use of the rim shield prevents the deposit of excess clay to the lip or rim of a molded article.

2 Claims, 8 Drawing Figures prior art

RIM SHIELD

CROSS-REFERENCE

This application is a continuation of patent application Ser. No. 845,980 and filed on Oct. 27, 1977, now abandoned.

BACKGROUND

The rim shield relates to porous molds that are used in molding ceramic articles in the process called slip casting. The rim shield is designed for use in the molding of containers from either high-fire or low-fire slip, however, the molding of ceramic objects not intended for use as containers might also benefit from the technological improvements indicated.

PRIOR ART

Briefly described, the process of slip casting involves the molding of ceramic articles by pouring a fluent clay stock, called slip, into the opening and cavity formed by the mated sections of a porous mold made from plaster of Paris. The cavity within the mold and below the opening is referred to as the ware-forming cavity, and its surface is preformed to the desired shape of the article to be molded. The interior surface of the ware-forming cavity is referred to as the ware-forming surface. After the ware-forming cavity has been filled with slip, the mold absorbs water from the slip causing a deposit of clay to be left on the ware-forming surface. When a sufficiently thick layer of clay has been so deposited, the remaining slip is evacuated by inverting the mold and pouring it out. The deposited clay is allowed to dry within the mold, thereby contracting sufficiently to form a self-sustaining article. The molded article is then removed from the ware-forming cavity following the separation of the mating sections of the mold.

The prior art uses molds which are designed to supply slip to the ware-forming cavity through an opening located directly above and in fluid communication with the ware-forming cavity. This opening provides an enclosed space that contains a reserve supply of slip during the ware-forming, allowing the reserve supply to be drawn into the ware-forming cavity as moisture from the slip is absorbed by the mold.

In the prior art, the surface of the opening is exposed to contact with slip during the ware-forming, causing a layer of excess clay to be deposited thereto. The deposit of excess clay is continuous to the rim and lip of the molded article, thereby making necessary a subsequent trimming operation to remove the excess clay deposit. The removal of the excess clay deposit in the trimming operation by manual cutting requires a substantial amount of time on the part of the craftsperson and frequently results in an irregular surface or ledge being imparted onto the inside of the lip or rim of the molded article, resulting in a product whose appearance and performance may be impaired. Breakage or distortion of the rim area may also occur during the trimming operation. Wastage of clay occurs when the excess deposit removed in the trimming is discarded.

SUMMARY

The present invention is summarized in that in a rim shield for use in conjunction with a porous mold having a ware-forming cavity therein and an opening formed in communication with the ware-forming cavity, for preventing the deposition of excess clay to the lip or rim of a ceramic article during its molding, the rim shield includes a central wall segment formed as a closed continuous surface shaped so as to interfit into the opening in the mold, a lower segment extending from the central segment, the lower segment being sized so as to be received within the ware-forming cavity of the mold so as to be positioned a predetermined distance from the interior of the ware-forming cavity, the lower segment being of sufficient length to prevent the deposition of excess clay on the lip or rim of the article, and the lower segment having a plurality of perforated holes formed in it in a horizontal row about its circumference located at a level so as to be positioned in the ware-forming in the mold adjacent the juncture of the opening and the ware-forming cavity in the mold when the rim shield is inserted into the mold.

DETAILED DESCRIPTION OF THE PREFERRED EMBODIMENT

Figure 1:
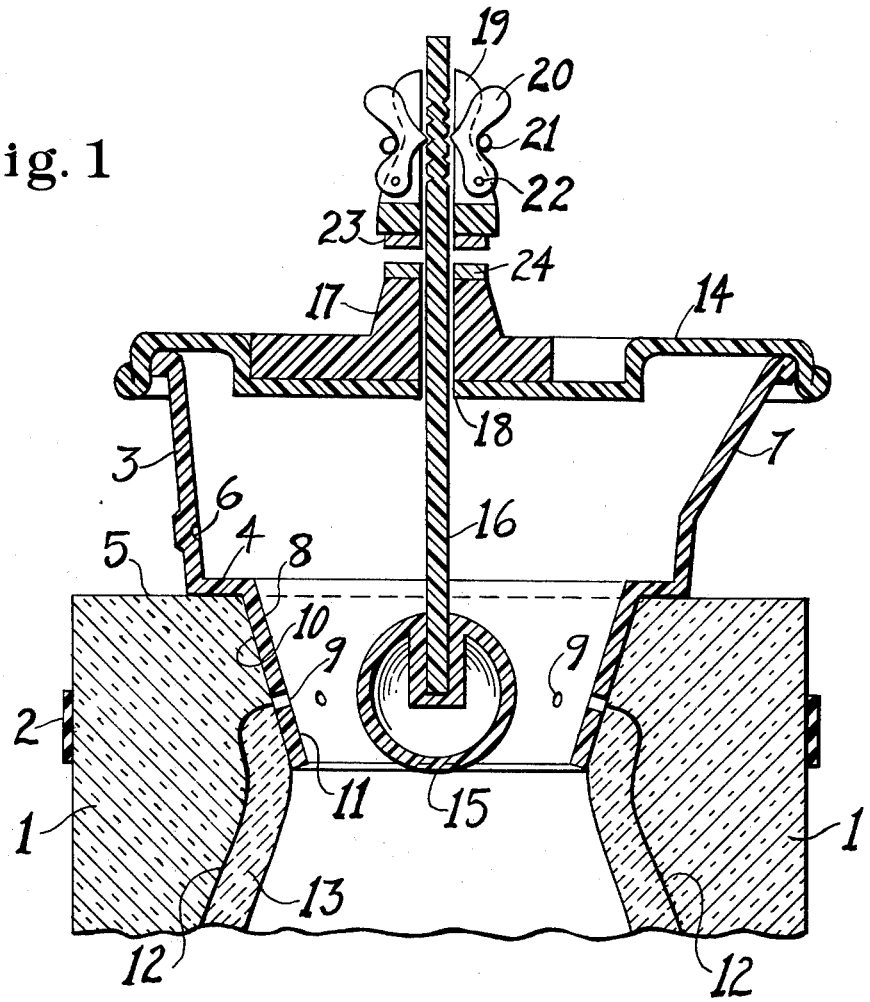
FIG. 1 is a sectional elevation view of the rim shield as it appears interfitted into the opening of a porous mold, partially drawn, and with a lid and a fluid level indicator assembly mounted on top.

In the preferred embodiment, the rim shield has the shape of a vertically segmented wall consisting of abutting, concentric, conical sections, and is used in conjunction with a porous mould having a ware-forming cavity therein and an opening formed in communication with the ware-forming cavity. The rim shield consists of three joined segments, the surfaces of which are closed and continuous. Upon insertion into the mold, the upper segment extends above the top side of the mold, the central segment interfits into the opening in the mold, and the lower segment extends into the ware-forming cavity.

In using the rim shield, it is separately immersed into water to deposit a film of moisture that will reduce the adherence of slip. It is then interfitted into the opening of the mold so that the central wall segment is in firm and continuous contact with the entire surface of the opening, said opening being defined by the entire mold surface situated between the ware-forming cavity and the top side of the mold. The central wall segment is sloped in an upwardly expanding direction of approximately 8 degrees in order to facilitate both insertion into and removal from the mold. Slight friction between the central wall segment and the adjacent surface of the mold opening acts to hold the rim shield in position.

Slip is added into the cavity of the mold formed by the mated sections until it reaches an indented marking on the upper wall segment denoting that there is sufficient slip in the cavity to complete the ware-forming. A lid and fluid-level indicator assembly are then placed on top of the upper wall segment of the rim shield. The enclosure formed by the lid over the upper wall segment significantly limits the evaporation of moisture from the slip, thereby reducing the film of slip deposited to the interior wall surface of the rim shield and helping to maintain the fluidity of the slip within the enclosure.

When the fluid-level indicator denotes that the desired thickness of clay deposit has been achieved in the ware-forming cavity, the lid is removed, the mold is inverted to evacuate excess slip, and mold is returned to its upright position. The rim shield is then removed and cleaned in water. After the molded article has dried and hardened sufficiently, the mating sections of the mold are disassembled to enable its removal. Since no excess clay is deposited to the lip or rim, no subsequent trimming operation is necessary.

The preferred mode of manufacture of the rim shield is plastic vacuuforming. The plastic is formed around a three-segment vacuuform mold, the central segment conforming to the shape of the opening in the porous, ware-forming mold. The shape of the remaining segments of the vacuuform mold are determined by the characteristics of the upper and lower wall segments of the rim shield as detailed in the following specifications. Suitable wall thickness of the rim shield is between 0.05 cm and 0.3 cm. The lid used with the rim shield is produced by vacuuforming; the components of the fluid-level indicator are produced using plastic injection molding.

Referring to FIG. 1 of the drawings, the rim shield is shown in conjunction with and interfitted into an upright plaster of Paris mold. The mold consists of two mating sections 1 held together by a rubber band 2. The rim shield consists of three closed, continuous, and vertically arranged segments. The upper segment 3 is bounded at the bottom by a shelf 4 which fits in contiguous contact against the top side 5 of the mold. Towards the bottom of this wall segment is an indented marking 6 which serves to denote the level to which slip is added into the mold cavity. A pour spout 7 is formed into the side of the upper wall segment to facilitate evacuation of slip.

The central wall segment 8 is preformed into a closed continuous surface shaped so as to interfit into the opening of the mold, said opening being defined by surface 10. The exterior surface of the central wall segment of the rim shield is contiguous to the entire surface of the opening of the mold, thereby preventing the deposit of clay to the surface of the opening when the mold is filled with slip. The central wall segment is bounded at the top by the shelf 4, and at the bottom by a plurality of perforated holes 9 formed in the wall in a horizontal row about its circumference.

The lower wall segment 11 extends from the central segment and is sized so as to be received within the ware-forming cavity of the mold so as to be positioned a predetermined distance from the interior of the ware-forming cavity, the interior surface being partially defined by surface 12. The resulting space between the lower wall segment and the adjacent ware-forming surface corresponds to the lip and rim of an article molded during the ware-forming and is equivalent to the desired thickness of the layer of clay 13 to be deposited to the ware-forming surface. Further deposition beyond the desired thickness is prevented by the lower wall segment of the rim shield. The lower wall segment has a length that is slightly greater than the desired thickness of clay deposit and is therefore of sufficient length to prevent the deposition of excess clay on the lip or rim of a molded article.

The perforated holes 9 are of a diameter of approximately 0.01 cm and spaced at 1 cm intervals. When the rim shield is in its appropriate position in the mold during the ware-forming, the location of the perforated holes aligns with the juncture of the ware-forming cavity with the opening of the mold. The holes thereby enable air trapped between the lower wall segment 11 and the adjacent interior surface of the ware-forming cavity to escape into the enclosure formed by the central and upper wall segments.

Above the upper segment 3 of the rim shield is positioned a lid 14 and a fluid-level indicator assembly which is mounted thereon. Although the lid and indicator are not included in the claims, they are an integral part of the correct functioning of the rim shield. Their use is essential to assure that the mold is evacuated of slip at the appropriate moment to prevent a ridge of excess clay from forming below the lower wall segment on the interior surface of the article being molded. The indicator assembly shown in FIG. 1 consists of: a spherical float 15, a rod 16 which extends into a supporting tower 17 through a vertical shaft 18; an adjustable cap 19 having two locking wings 20 under pressure from a rubber band 21 and pivoting on metal pins 22; and a metal ring 23 and two metal contact terminals 24 which enable attachment to a light or buzzer signal. The cap 19 of the indicator is adjusted so that contact of the metal components 23 and 24 indicates the appropriate time for evacuating slip from the mold.

Figure 2:
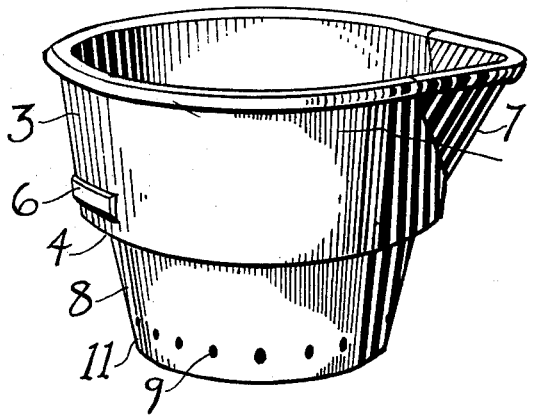
FIG. 2 is a perspective view of the rim shield of FIG. 1 as it appears constructed for use with a mold whose ware-forming cavity and opening are concentric.

Referring to FIG. 2, the rim shield of FIG. 1 is shown as it appears for use with a porous mold whose opening and ware-forming cavity are concentric.

Figure 3:
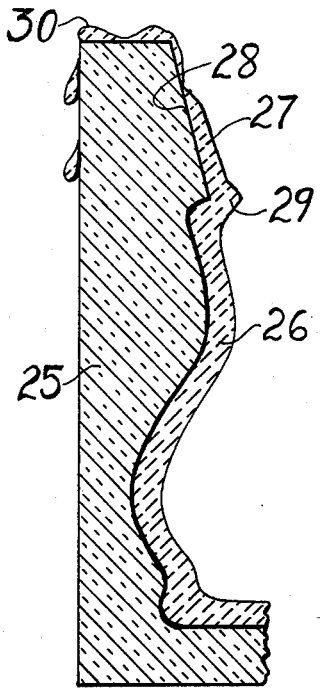
Fig. 3 prior art
FIG. 3 is a partial, cross-sectional view of a porous mold and molded article according to the prior art, as it appears immediately following evacuation of slip from the mold.
Figure 4:
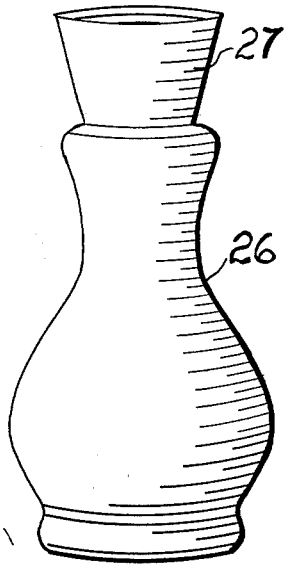
Fig. 4 prior art
FIG. 4 is a perspective view of a molded article from the mold of FIG. 3, according to the prior art, as it appears immediately after removal from the ware-forming cavity of the mold.
Figure 5:
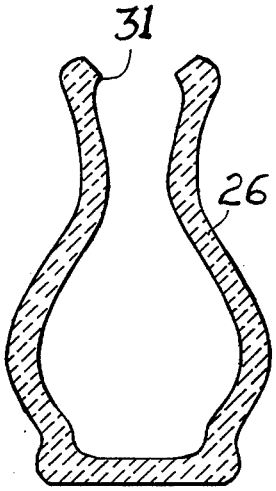
FIG. 5 is a cross-sectional view of the molded article of FIG. 3 immediately following a trimming operation to remove the excess deposit from the rim.

FIGS. 3, 4, and 5 pertain to the prior art. In FIG. 3, a common example of a porous mold and molded article as they appear according to the prior art are shown in cross-section. The mold 25 and the molded article 26 do not benefit from the sheilding afforded by a rim shield. Therefore, an excess clay deposit 27 forms on the exposed mold surface of the opening 28, said clay deposit being attached to the molded article above its lip and rim. An additional excess clay deposit 29 which typically forms on the interior lip of the molded article is also indicated. During the evacuation of slip, additional lumps 30 of excess clay may be deposited to the top side of the mold. The deposit of these lumps necessitates cleaning of the mold. FIG. 4 shows a perspective view of the molded article 26 of FIG. 3, as it appears immediately following removal from the mold. The waste deposit 27 above the rim of the article must be removed in a subsequent trimming operation. FIG. 5 shows a cross-sectional view of the molded article 26 of FIG. 3 according to the prior art immediately after the wastage above the rim has been removed. Even after trimming, an uneven ridge 31 frequently remains on the interior lip surface of the molded article.

Figure 6:
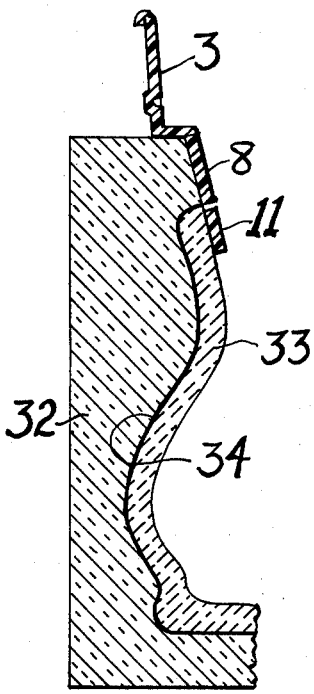
FIG. 6 is a partial, cross-sectional view of a porous mold and molded article in which the rim shield of FIG. 1 is used and as it appears immediately following the evacuation of slip from the mold.
Figure 7:
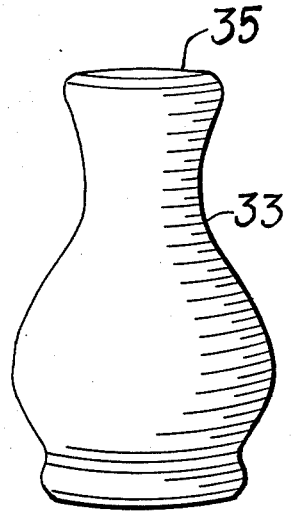
FIG. 7 is a perspective view of a molded article from the mold and rim shield of FIG. 6, as it appears immediately following removal from the ware-forming cavity of the mold.
Figure 8:
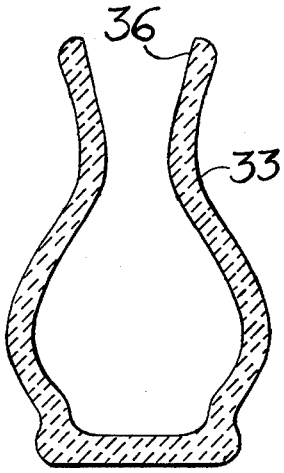
FIG. 8 is a cross-sectional view of the molded article of FIG. 6 as it appears immediately following removal from the ware-forming cavity of the mold.

FIGS. 6, 7, and 8 pertain to the molding of articles using the rim shield in conjunction with a pourous mold. In FIG. 6, a cross-sectional view of a portion of a porous mold 32 and a molded article 33 is shown in which the rim shield of FIG. 1 is used during the ware-forming. Clay is deposited only to the ware-forming surface 34. FIG. 7 depicts a perspective view of the molded article 33 of FIG. 6 as it appears immediately after removal from the ware-forming cavity. There is no excess waste deposit of clay above the rim 35 of the molded article which would otherwise require a trimming operation. A cross-sectional view of the molded article 33 of FIG. 7 is presented in FIG. 8 indicating the smooth surface 36 imparted to the interior lip of the article by the lower segment of the rim shield.

The primary and novel aspect of the rim shield used in conjunction with a porous mold is the function it performs of shielding the mold opening, and the rim and interior lip surface of a molded article from excess clay deposit. The improvement over the prior art results in a savings of time and material in the slip casting process and enables the production of a more uniform product than was previously possible. The rim shield has a broad applicability to use with porous molds for molding hollow ceramic articles having a variety of lip and rim shapes to which the configuration of the rim shield can be adapted. In view of the modifications that can be made by those skilled in the art of ceramic slip casting, it is intended that the invention be limited solely by the scope of the appended claims.

What is claimed is:

1. A rim shield for use in conjunction with a porous mold having a ware-forming cavity therein and an opening formed in communication with the ware-forming cavity, for preventing the deposition of excess clay to the lip or rim of a ceramic article during its molding, the rim shield comprising:

a central wall segment formed as a closed continuous surface shaped so as to interfit into the opening in the mold, a lower segment extending from the central segment, the lower segment being sized so as to be received within the ware-forming cavity of the mold so as to be positioned a predetermined distance from the interior of the ware-forming cavity, the lower segment being of sufficient length to prevent the deposition of excess clay on the lip or rim of the article, and the lower segment having a plurality of perforated holes formed in it in a horizontal row about its circumference located at a level so as to be positioned in the ware-forming in the mold adjacent the juncture of the opening and the ware-forming cavity in the mold when the rim shield is inserted into the mold.

2. Apparatus for molding a ceramic article comprising:

a porous mold having a ware-forming cavity formed therein and an opening formed therein opening onto one side thereof and in communication with the cavity;

a rim shield for preventing the deposition of excess clay to the lip of the article during its molding;

a central wall segment of the rim shield formed as a closed continuous surface shaped so as to interfit into the opening in the mold;

a lower segment of the rim shield extending from the central segment, the lower segment being sized so as to be received within the ware-forming cavity of the mold so as to be positioned a perdetermined distance from the interior of the ware-forming cavity, the lower segment being of sufficient length to prevent the deposition of excess clay on the lip or rim of the article, and the lower segment having a plurality of perforated holes formed in it in a horizontal row about its circumference located at a level so as to be positioned in the ware-forming in the mold adjacent the juncture of the opening and the ware-forming cavity in the mold when the rim shield is inserted into the mold.

* * * * *